US006446710B2

(12) United States Patent
Beeck et al.

(10) Patent No.: US 6,446,710 B2
(45) Date of Patent: Sep. 10, 2002

(54) ARRANGEMENT FOR COOLING A FLOW-PASSAGE WALL SURRROUNDING A FLOW PASSAGE, HAVING AT LEAST ONE RIB ELEMENT

(75) Inventors: Alexander Beeck, Küssaberg (DE); Bernhard Bonhoff, Baden (CH); Sacha Parneix, Zürich (CH); Bernhard Weigand, Filderstadt-Sielmingen (DE)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/726,424

(22) Filed: Dec. 1, 2000

(30) Foreign Application Priority Data

Dec. 28, 1999 (DE) ..... 199 63 374

(51) Int. Cl.[7] ..... F28F 13/12

(52) U.S. Cl. ..... 165/109.1; 415/115; 416/96 R; 137/809

(58) Field of Search ..... 165/109.1, 133, 165/908, 184; 415/115, 914; 416/96 R; 137/809, 811

(56) References Cited

U.S. PATENT DOCUMENTS

| | | | | |
|---|---|---|---|---|
| 2,691,991 A | * | 10/1954 | Schutt et al. | 165/109.1 |
| 5,361,828 A | * | 11/1994 | Lee et al. | 165/109.1 |
| 5,803,165 A | * | 9/1998 | Shikazono et al. | 165/184 |
| 6,092,982 A | * | 7/2000 | Ikeda et al. | 415/115 |

FOREIGN PATENT DOCUMENTS

| | | | |
|---|---|---|---|
| DE | 648190 | | 7/1937 |
| DE | 2416309 | | 2/1975 |
| DE | 195 26 917 | A1 | 1/1997 |
| DE | 19628548 | A1 | 1/1998 |
| DE | 29822241 | U1 | 4/1999 |
| EP | 0542478 | A1 | 5/1993 |
| EP | 0 845 580 | A2 | 6/1998 |
| JP | A-59-66648 | | 4/1984 |
| JP | 59-119192 | A * | 7/1984 |
| JP | A-7-190663 | | 7/1995 |
| WO | WO 96/11372 | | 4/1996 |
| WO | WO 99/24772 | | 5/1999 |

* cited by examiner

*Primary Examiner*—Henry Bennett
*Assistant Examiner*—Terrell McKinnon
(74) *Attorney, Agent, or Firm*—Burns, Doane, Swecker & Mathis, L.L.P.

(57) ABSTRACT

An arrangement for cooling a flow-passage wall surrounding a flow passage is described, having at least one rib element which induces flow vortices in a flow medium passing through the flow passage, is attached to that side of the flow-passage wall which faces the flow passage, and the shape and size of which are selected in accordance with a certain heat transfer coefficient and a certain pressure loss caused in the flow medium due to the latter flowing over the rib element.

The invention is characterized in that the rib element, while largely retaining its original shape and/or size, has contours enlarging its surface facing the flow passage.

14 Claims, 5 Drawing Sheets

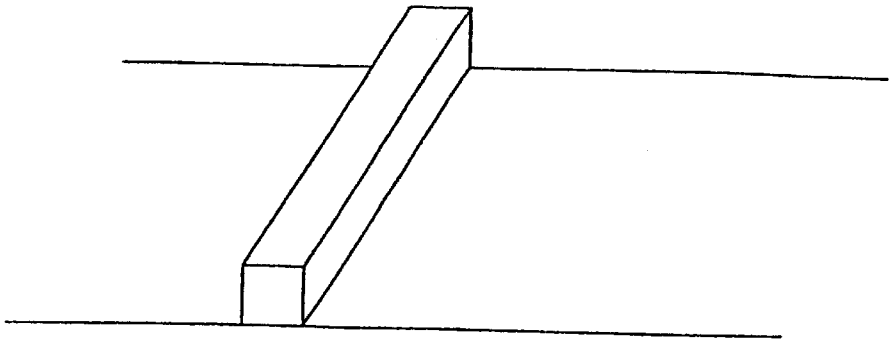
a)
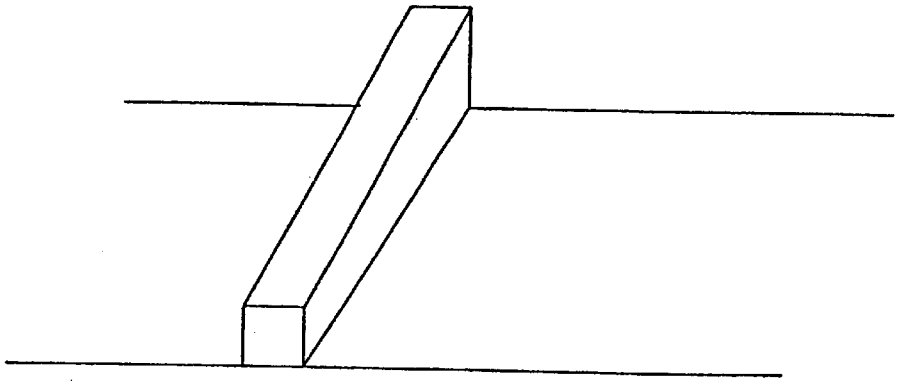
b)
Fig. 3
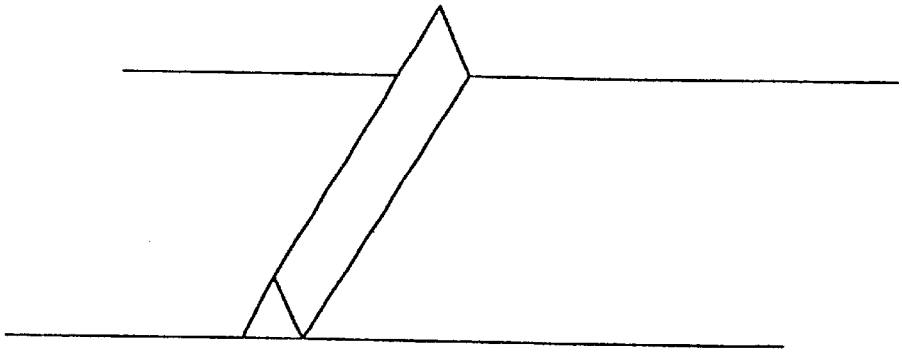
c)
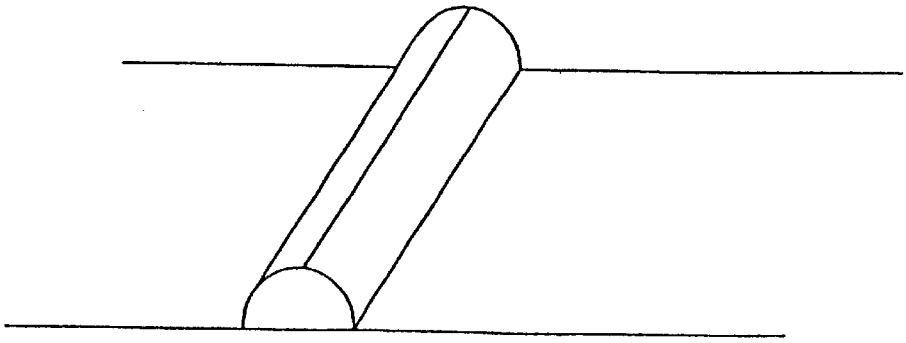
d)

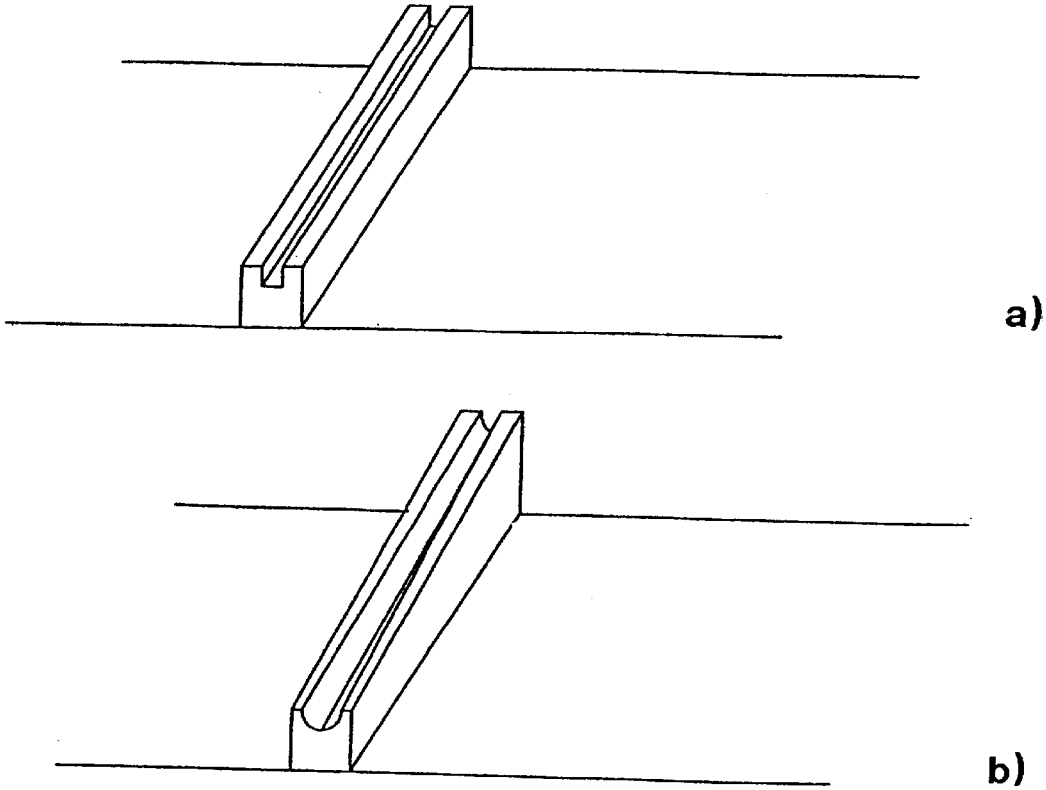
Fig. 4
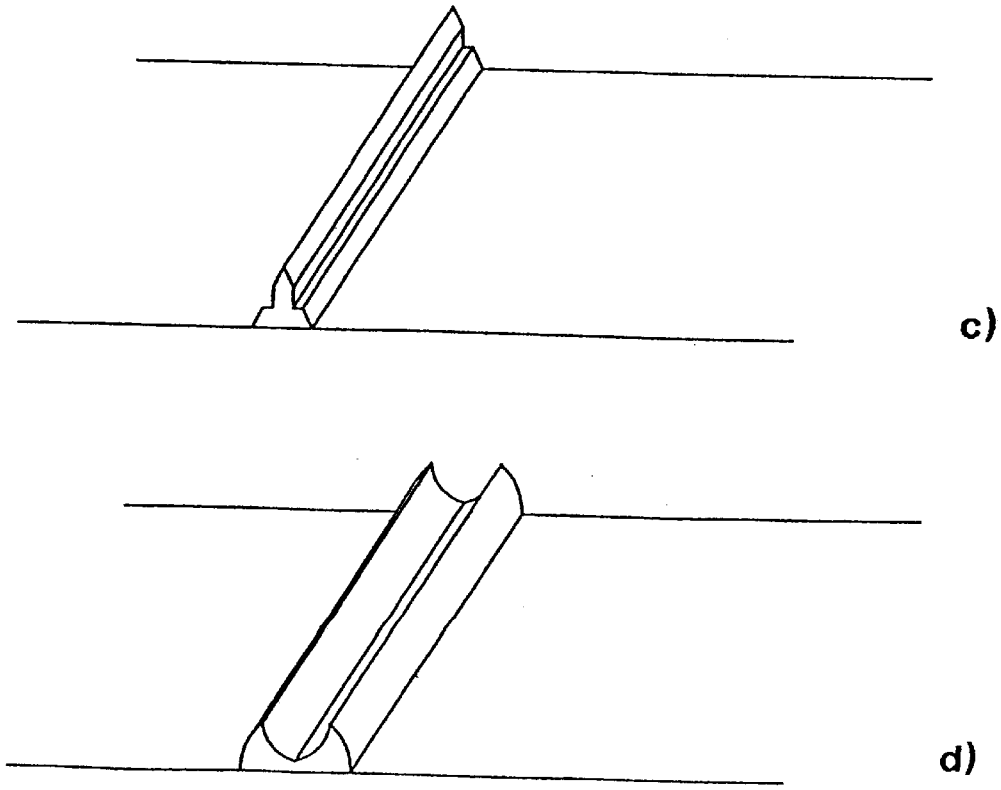

ARRANGEMENT FOR COOLING A FLOW-PASSAGE WALL SURRROUNDING A FLOW PASSAGE, HAVING AT LEAST ONE RIB ELEMENT

This application claims priority under 35 U.S.C. §§119 and/or 365 to Application No. 199 63 374.6 filed in Germany on Dec. 28, 1999; the entire content of which is hereby incorporated by reference.

FIELD OF THE INVENTION

The invention relates to an arrangement for cooling a flow-passage wall surrounding a flow passage, having at least one rib element which induces flow vortices in a flow medium passing through the flow passage.

BACKGROUND OF THE INVENTION

In the field of gas turbine technology, great efforts are made to increase the efficiency of such plants. It is known that a temperature increase in the hot gases produced by the combustion of an air/fuel mixture inside the combustion chamber is at the same time associated with an increase in the gas-turbine efficiency. However, an increase in the process temperature requires all of those plant components which come into direct thermal contact with the hot gases to have a high heat resistance. However, the heat resistance, even in the case of especially heat-resistant materials, is limited toward the top of the temperature scale, so that melting of the material is unavoidable if certain limit temperatures specific to the material are exceeded. In order to avoid such melting actions and yet ensure high process temperatures inside the gas-turbine system, cooling systems are known which specifically cool those plant components which are directly exposed to the hot gases. Thus, for example, the turbine blades, just like the combustion-chamber walls, are combined with cooling passages through which, compared with the temperatures of the hot gases, relatively cold air is fed, this cold air being branched off, for example, from the air compressor stage for cooling purposes. The cooling-air flow flowing through the cooling passages cools the cooling-passage walls and is itself heated by the latter. In order to improve the cooling effect and the heat transfer associated therewith from the cooling-passage walls to the cooling medium, air, measures have been taken which enable the thermal coupling between cooling medium and cooling-passage wall to be optimized. Thus it is known that, by the provision of rib features on the inner wall of the cooling passage, specific turbulent flow portions can be produced within the cooling-medium flow passing through the cooling passage, and these turbulent flow portions have flow components perpendicular to the cooling-passage wall. In this way, the portion of the cooling-medium mass flow which comes into direct thermal contact with the cooling-passage walls is increased decisively, as a result of which the cooling effect is also considerably improved. Thus, by the provision of appropriate rib features along the cooling-passage wall, a so-called secondary flow forms in addition to the main flow flowing through the cooling passage, the flow portions of which secondary flow, as indicated above, have directions of flow which are largely directed perpendicularly to and away from the cooling-passage wall. In particular in the case of rib features which are of rectilinear form and are arranged at an angle to the main flow direction, it has been found that relatively stable and sharply pronounced secondary flow vortices are formed, and these secondary flow vortices lead to increased intermixing of the boundary layer close to the cooling-passage wall, and this increased intermixing enables an increased amount of cold cooling air to pass to the hot cooling-passage walls.

Extensive studies have been carried out in connection with the rib features inside cooling passages and the effect associated therewith on the heat transfer coefficient occurring between the cooling wall and the cooling medium flowing through the cooling passage. In particular, the studies related to the influence which diverse parameters characterizing the rib features exert on the heat transfer coefficient and on the pressure loss associated with the flow over a rib feature, such as, for example, rib height, inclination of the rib flanks or angular orientation of the ribs of rectilinear design relative to the main flow direction, Reynolds and Prandtl number, the aspect ratio of the cooling-passage cross section, or the rotational vortices forming within the flow of the cooling air, to mention just a few parameters. Most optimization efforts with regard to design and arrangement of the rib features inside cooling passages were restricted to the optimization of the rib cross section.

SUMMARY OF THE INVENTION

The object of the invention is to develop an arrangement for cooling a flow-passage wall surrounding a flow passage, having at least one rib element which induces flow vortices in a flow medium passing through the flow passage, is attached to that side of the flow-passage wall which faces the flow passage, and the shape and size of which are selected in accordance with a certain heat transfer coefficient and a certain pressure loss caused in the flow medium due to the latter flowing over the rib element, in such a way that the cooling effect of the flow medium passing through the flow passage is to be further increased without at the same time affecting the heat transfer coefficient, which hinders optimization through the shape and size of the rib element, between cooling-passage wall and flow medium and without sustaining an increase in the pressure loss caused by the flow medium flowing over the rib element. With regard to their production, measures increasing the cooling effect are to involve little outlay and low production costs.

According to the invention, the rib element, while largely retaining its original shape and/or size, has contours enlarging its surface facing the flow passage.

Thus the idea according to the invention is based on the optimization of the outer rib contour with the aim of increasing the heat-transferring surface between rib and flow medium, yet the heat transfer coefficient, defined by the rib form, of the rib and the pressure loss, caused by the rib form, in the flow medium are to remain essentially unaffected.

It has thus been recognized that measures which enlarge the surface of the rib element and which largely have no effect on the heat transfer coefficient and the pressure loss caused by the rib element can have a direct and decisive effect on a marked increase in the heat transfer between the cooling-passage wall and the cooling-medium flow passing through the cooling passage. In particular, the generation of secondary vortices, which is due to the rib elements opposed to the cooling-medium flow, at least in its marginal regions, must be left largely unaffected, so that measures enlarging the surfaces can be produced merely by a slight modification to the rib surfaces.

DESCRIPTION OF THE DRAWINGS

The invention is described with reference to the drawings, in which:

FIGS. 3*a–d* are schematic perspective views of various geometrical rib configurations with largely uniform cross-sectional geometry along the rib longitudinal axis, FIGS. 4*a–d* are perspective views of geometrical rib configurations with groove-shaped recesses.

DETAILED DESCRIPTION OF THE INVENTION

Figure 1:
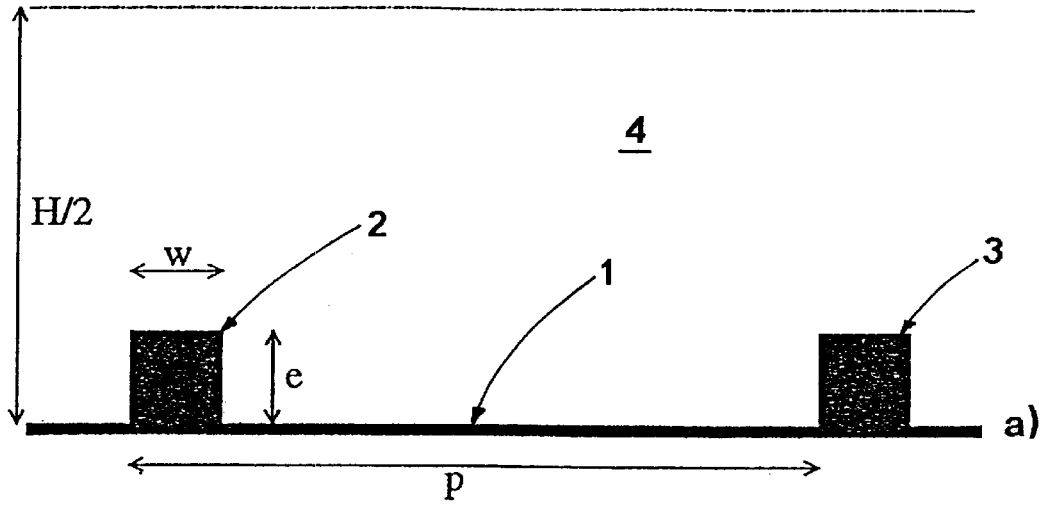
FIGS. 1*a, b* is schematic cross sectional view of rectangular ribs known per se and rectangular ribs according to the invention.

Shown in FIG. 1*a* in a cross-sectional representation is a side of a cooling-passage wall 1, on the flow-passage inner wall of which two rib elements 2, 3 are provided. These rib elements 2, 3 each have a rectangular cross section. A cooling passage is typically defined by four side walls, of which two opposite side walls are provided with rib elements, which are in each case arranged one behind the other in a multiple sequence in the direction of flow. Shown in FIG. 1*a* in longitudinal section is merely one half of a cooling passage 4, whose cooling-passage walls provided with rib elements are spaced apart by the width H (the cooling passage is only shown up to H/2). For fluidic reasons and in particular for a specific formation of so-called secondary vortices, the rib longitudinal axis of each individual rib element encloses an angle of about 45' with the main flow direction of the cooling air passing through the flow passage.

Based on optimization calculations with regard to a desired heat transfer coefficient and as far as possible a minimum pressure loss, which occurs when the flow medium flows over each individual rib element, the following dimensioning conditions apply to rib elements of rectangular design in cross section: the rib height e is about 10% of the cooling passage height H, which at the same time also corresponds to the hydraulic diameter of the cooling passage. The ratio of the spacing p of two rib elements 2, 3 arranged directly adjacent to one another in the longitudinal direction of the cooling passage to the rib height e is about 10. Starting from dimensioning described above for the rib elements arranged in the cooling passage, the idea according to the invention provides for the surface of each individual rib element to be specifically enlarged, for example by means of the measure shown in FIG. 1*b*, namely by making a longitudinal groove in each individual rib element, the properties of each individual rib element with regard to the flow dynamics remaining unchanged to a very large extent. The surface of the rib element is markedly enlarged by making a rectangular groove 5 inside the rib element 2, 3. On the assumption that the following relationships apply to the spacings depicted in FIG. 1*b:*

$$a=c=w/4$$

$$b=w/2$$

$$d=e/2$$

the following may be stated:

The surface portion which is formed by the rib-element surfaces is 25% in relation to the entire heat transfer surface inside a cooling passage in the case of the design of a rib element according to FIG. 1*a*. If the rib elements are provided with a groove according to the exemplary embodiment of FIG. 1*b*, their surface portion, measured against the entire heat transfer surface inside a cooling passage, is in the order of magnitude of 33%. Compared with the exemplary embodiment according to FIG. 1*a*, this leads to an increase of 8.3% in the entire heat exchange surface inside a cooling passage. On the assumption that the surface inside the groove contributes to the heat exchange in the same way as the remaining surface of the rib element, the increase to be expected in the heat transfer by means of the measure according to the invention is 8.3%, that is to say the heat transfer has increased by just as much as the heat transfer surface in the entire system.

Figure 2:
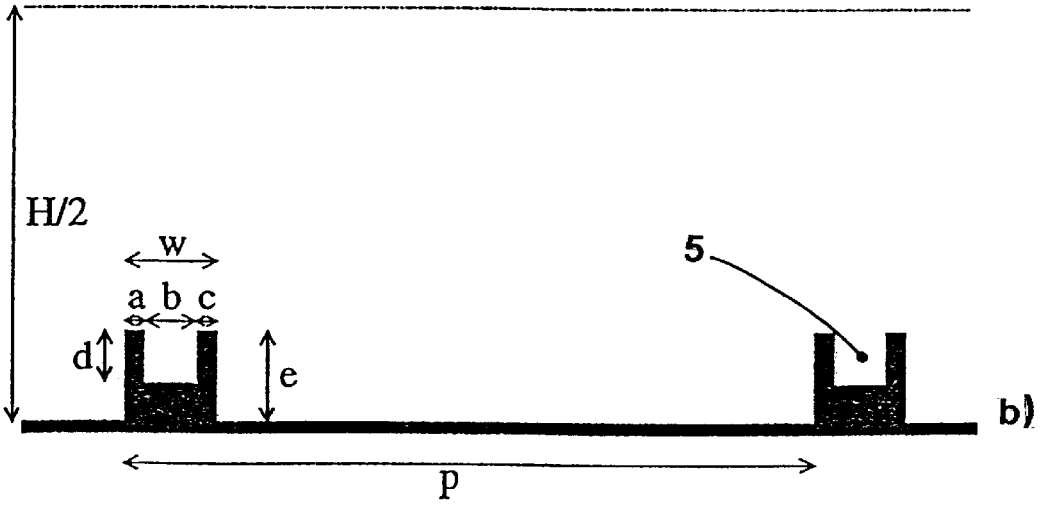
FIG. 2 is a schematic cross sectional of a rectangular rib with multiple channels.
Figure 2:
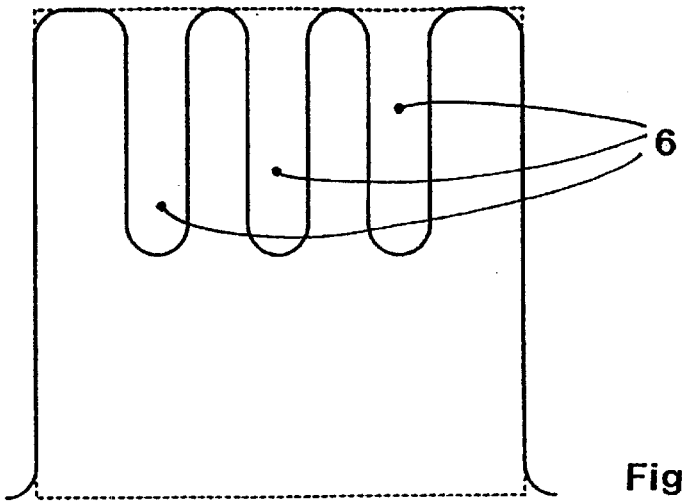

Shown in FIG. 2 is a further embodiment of a rib element which has a rectangular cross section and three channels 6 for the purpose of enlarging the surface. In addition, the edges are rounded off.

As can be seen from FIGS. 3*a–d*, other cross-sectional shapes may also be used for the rib elements, in which case surface-enlarging measures are not restricted solely to making recessed portions in the rib elements.

A conventional rectangular rib which has a uniform cross section over its entire length is shown in FIG. 3*a*. In contrast, the rectangular rib shown in FIG. 3*b* has a rectangular cross section increasing along its extent. The same applies to the triangular rib shown in FIG. 3*c* and to the rib shown in FIG. 3*d*, the cross-sectional shape of which is of semicircular design and has a continuously increasing radius in the rib longitudinal direction. In principle, all the geometrical parameters of the rib element, such as rib height, rib width, spacing between two adjacent ribs in relation to their height, and the inclination of the rib axis, may be varied for a surface enlargement.

Combinations of channels or grooves and specific cross-sectional changes along the rib longitudinal axis are shown in FIGS. 4*a-d*. FIG. 4*a* shows a rectangular rib of constant rib cross section and a groove made therein. FIG. 4*b* shows a rib element having a rectangular groove and a rectangular cross section increasing in the rib longitudinal direction and a recess made in a semicircular shape. FIG. 4*c* shows a rib which is designed in a triangular cross-sectional shape and on the two side flanks of which recesses of rectilinear design are provided. FIG. 4*d* has an original cross section of semicircular design, in which a parabolic recess is made.

Figure 5:
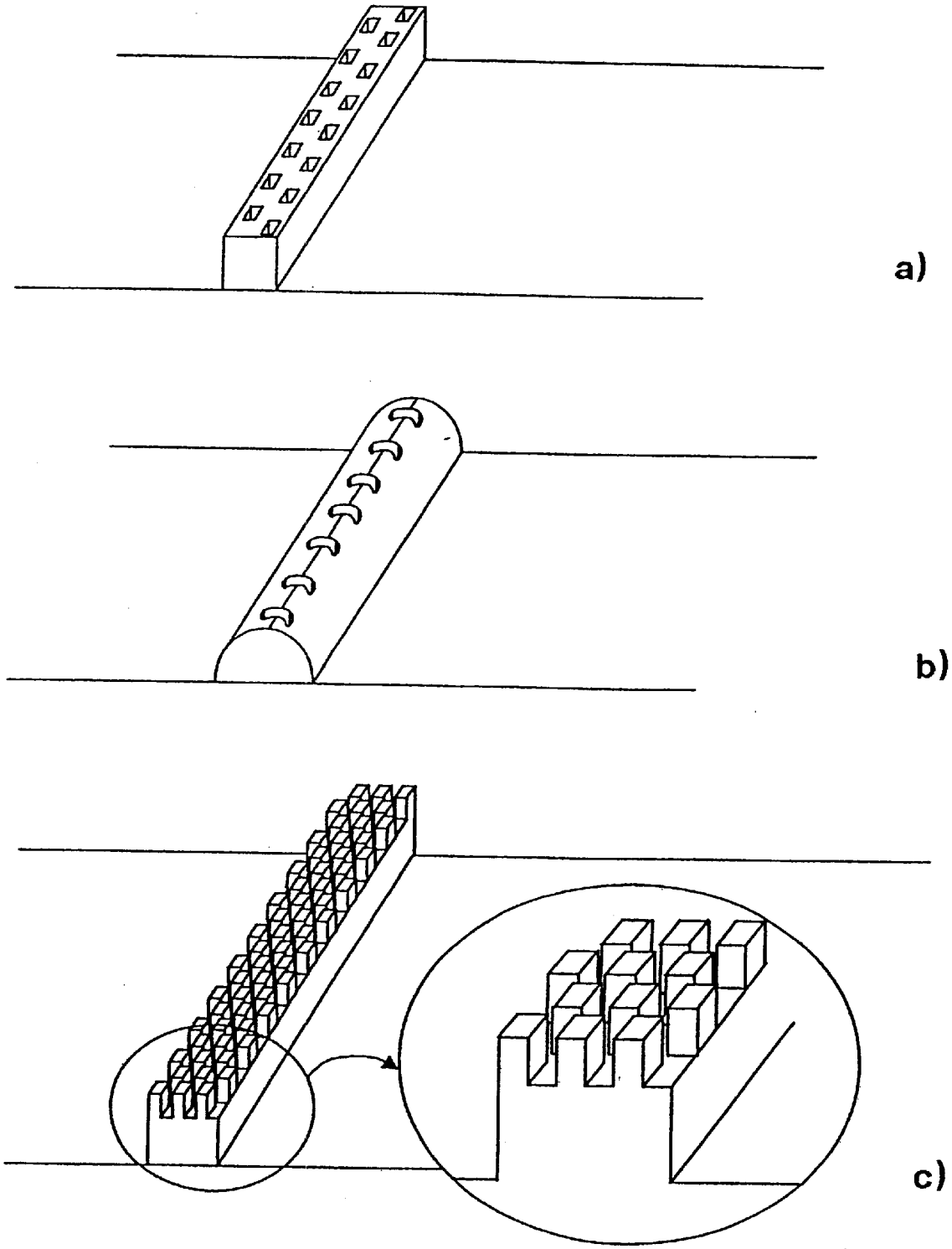
FIGS. 5*a–c* are perspective views of various geometrical rib configurations with three-dimensional recesses.

Three-dimensional recessed portions may also be made in the rib elements, as can be seen from FIGS. 5*a*–5*c*.

A rib of rectangular design having recessed portions of rectangular design is shown in FIG. 5*a*. FIG. 5*b* shows a rib of semicircular design in cross section and having recessed portions of cylindrical design. FIG. 5*c* has three-dimensional cubic bodies at its surface, which make possible an especially large surface enlargement.

In principle, all the measures shown above by way of example for enlarging the rib surface may be combined with one another.

Figure 6:
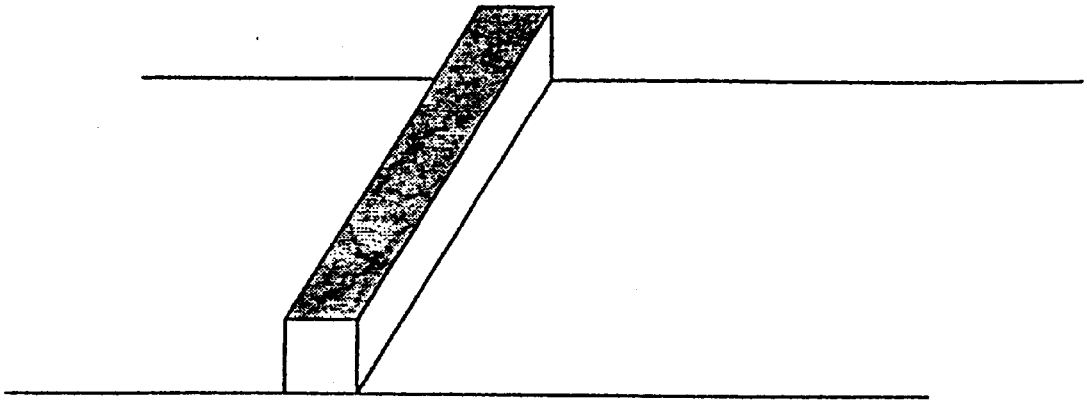
FIG. 6 is a perspective view of a rib form which roughened surface.

It is also possible to enlarge the surface of the rib element by specific surface roughening as shown in FIG. 6 in order to increase the heat transfer in this way. Although this measure changes the shape and geometry of the rib feature least of all compared with the exemplary embodiments shown above, the surface-enlarging effect is more limited.

What is claimed is:

1. An arrangement for cooling a flow-passage wall comprising a flow passage having at least one rib element which induces flow vortices in a flow medium passing through the flow passage, attached to that side of the flow-passage wall which faces the flow passage and the shape and size of which are selected in accordance with a certain heat transfer coefficient and a certain pressure loss caused in the flow medium due to the latter flowing over the rib element, wherein the rib element, while largely retaining its original shape and/or size, has contours enlarging its surface facing the flow passage, the rib element has a square or rectangular cross section and, as a contour enlarging its surface, has a grove on its side facing the flow passage, and the rib element has a rib width w and a rib height e, and the groove has a groove depth d and a groove width b, and in that the relationship b=w/2 and d=e/2 are approximately true.

2. A flow passage for cooling hot gases as the gases flow through the passage, the flow passage comprising: opposite side walls and additional walls enclosing the passage, a rib element mounted on one of the side walls, the rib element having a surface spaced from the side wall, the surface having a recess, thereby enlarging the surface of the rib element, and the passage includes a plurality of rib elements mounted on one of the side walls, the rib element being spaced apart a distance of 10 times the height of the rib element above the side wall.

3. A flow passage for cooling hot gases as the gases flow through the passage, the flow passage comprising: opposite side walls and additional walls enclosing the passage, a rib element mounted on one of the side walls, the rib element having a surface spaced from the side wall, the surface having a recess, thereby enlarging the surface of the rib element, and the flow passage includes a second wall opposite the first mentioned side wall, the distance between the opposite side walls, the rib height being about 10% of the distance between the side walls.

4. The flow passage as claimed in claim 2 or claim 3, wherein the rib element has a plurality of recesses enlarging the surface.

5. The flow passage as claimed in claim 2 or claim 3, wherein the rib element has a uniform cross section along its length.

6. An arrangement for cooling a flow-passage wall comprising a flow passage having a least one rib element which induces flow vortices in a flow medium passing through the flow passage, attached to that side of the flow-passage wall which faces the flow passage, and the shape and size of which are selected in accordance with a certain heat transfer coefficient and a certain pressure loss caused in the flow medium due to the latter flowing over the rib element wherein the rib element, while largely retaining its original shape and/or size, has contours enlarging its surface facing the flow passage, the contours enlarging the surface are designed as longitudinal channels or grooves which are made in the rib element extending along the length of the rib element and positioned at approximately a middle portion of the surface.

7. The arrangement for cooling a flow-passage wall as cooling gases flow through the passage, the arrangement comprising:

opposite walls enclosing the passage, a rib element mounted on at least one of the opposite walls, said rib element causing a secondary flow in the form of vortices in the cooling gas flow, the secondary flow enhancing cooling of the flow-passage wall, the rib element having a surface spaced from the at least one of the opposite walls on which it is mounted, the surface having at least one recess that enlarges the surface of the rib element and increases the heat transfer between the flow-passage wall and the cooling gases while having substantially no effect on the overall shape and size of the rib element.

8. The arrangement as claimed in claim 7, wherein the at least one recess enlarging the surface facing the flow passage is designed in such a way that neither the heat transfer coefficient of the rib element nor the flow-induced pressure loss caused by the rib element is substantially changed.

9. The arrangement as claimed in claim 7, wherein the at least one recess enlarging the surface is designed as a channel or a groove which is made in the rib element.

10. The arrangement as claimed in claim 9, wherein the channels and/or grooves are provided in a comb-like manner on the surface of the rib element.

11. The arrangement as claimed in claim 7, wherein the at least one recess enlarging the surface is a bore of a milled-out portion which is made in the rib element.

12. The arrangement as claimed in claim 7, wherein the surface of the rib element has surface roughness.

13. The arrangement as claimed in claim 7, wherein at least one rib element is arranged on each of said opposite walls enclosing said flow passage.

14. The arrangement as claimed in claim 7, wherein the at least one recess enlarging the surface is designed as a longitudinal channel or groove which is made in the rib element extending along the length of the rib element and positioned at approximately a middle portion of the surface.

* * * * *